US011186389B2

(12) United States Patent
Verma et al.

(10) Patent No.: US 11,186,389 B2
(45) Date of Patent: Nov. 30, 2021

(54) EVACUATION/FILL STATION FOR RADIOACTIVE FLUID CONTAINER PRODUCTION

(71) Applicant: Curium US LLC, St. Louis, MO (US)

(72) Inventors: Sumit Verma, Chesterfield, MO (US); Kevin B. Graves, Catawissa, MO (US)

(73) Assignee: CURIUM US LLC, St. Louis, MO (US)

( * ) Notice: Subject to any disclaimer, the term of this patent is extended or adjusted under 35 U.S.C. 154(b) by 176 days.

(21) Appl. No.: 16/433,181

(22) Filed: Jun. 6, 2019

(65) Prior Publication Data

US 2019/0382143 A1 Dec. 19, 2019

Related U.S. Application Data

(60) Provisional application No. 62/685,071, filed on Jun. 14, 2018.

(51) Int. Cl.
*B65B 3/00* (2006.01)
*B65B 43/52* (2006.01)
(Continued)

(52) U.S. Cl.
CPC ..... *B65B 3/003* (2013.01); *B65B 3/12* (2013.01); *B65B 31/044* (2013.01); *B65B 43/52* (2013.01); *B65B 57/10* (2013.01)

(58) Field of Classification Search
CPC ..... B65B 3/003; B65B 3/12; B65B 31/044; B65B 43/52; B65B 57/10
(Continued)

(56) References Cited

U.S. PATENT DOCUMENTS 3,687,261 A * 8/1972 Guckel ..... B65B 55/027 198/480.1
3,893,278 A * 7/1975 Lewis ..... A61K 51/1262 53/401
(Continued)

FOREIGN PATENT DOCUMENTS

DE 4320098 A1 12/1994
DE 19909995 A1 9/2000
(Continued)

*Primary Examiner* — Thanh K Truong
*Assistant Examiner* — Xavier A Madison
(74) *Attorney, Agent, or Firm* — Snell & Wilmer L.L.P.

(57) ABSTRACT

A unit dose container production system (10) is disclosed where a unit dose container (130) is evacuated and thereafter loaded with a radioactive fluid while remaining at a single location. In this regard, the production system (10) uses a first conveyor (12) to sequentially load unit dose containers (130) into an empty container receptacle (24) of a second conveyor (20) at a first location (90). The second conveyor (20) may be operated to dispose a container receptacle (24) at each of the first location (90), a second location (100), and a third location (110). A unit dose container (130) at the second location (100) is evacuated and thereafter loaded with a radioactive fluid, and is thereafter moved to a third location (110) by the second conveyor (20). The unit dose container (130) is removed from the second conveyor (20) at the third location (110), and thereafter the radioactivity content of a unit dose container (130) may be determined, such as at an ionization chamber or the like.

44 Claims, 3 Drawing Sheets

(51) Int. Cl.
*B65B 57/10* (2006.01)
*B65B 3/12* (2006.01)
*B65B 31/04* (2006.01)

(58) Field of Classification Search
USPC ..... 53/473
See application file for complete search history.

(56) References Cited

U.S. PATENT DOCUMENTS 4,041,994 A 8/1977 Horwitz et al.
5,039,863 A * 8/1991 Matsuno ..... G01T 7/02 250/432 PD
5,720,148 A 2/1998 Bedin et al.
6,494,824 B1 * 12/2002 Apple ..... A61M 5/1785 600/3
6,640,842 B1 11/2003 Laukenmann et al.
6,929,040 B2 8/2005 Py
7,374,054 B2 5/2008 Brockwell
7,568,509 B2 8/2009 Py
7,734,331 B2 * 6/2010 Dhawale ..... G01T 1/00 600/431
8,235,935 B2 8/2012 Wright et al.
8,448,674 B2 5/2013 Py
8,720,496 B2 5/2014 Huwiler et al.
2004/0199105 A1 10/2004 Nussey
2006/0191594 A1 * 8/2006 Py ..... B29C 65/18 141/329
2012/0222774 A1 9/2012 Husnu et al.
2013/0102772 A1 4/2013 Eshima et al.
2013/0123567 A1 5/2013 Agamaite et al.
2014/0221721 A1 8/2014 Bermudez et al.
2017/0100306 A1 4/2017 Weikart et al.
2017/0281876 A1 10/2017 Odell et al.
2017/0320673 A1 11/2017 D'Hooge et al.

FOREIGN PATENT DOCUMENTS

FR 3036389 A1 11/2016
JP 2014136120 A 7/2014
WO 2011132657 A1 10/2011
WO 2013072042 A1 5/2013

* cited by examiner

EVACUATION/FILL STATION FOR RADIOACTIVE FLUID CONTAINER PRODUCTION

CROSS-REFERENCE TO RELATED APPLICATIONS

This patent application is a non-provisional patent application of, and claims the benefit, U.S. Provisional Patent Application No. 62/685,071, that was filed on Jun. 14, 2018, and the entire disclosure of which is hereby incorporated by reference herein.

FIELD

The present invention is applicable to radioactive fluid containers (i.e., a container with a radioactive fluid) and, more particularly, to the manner of evacuating fluid from a container and thereafter loading a radioactive fluid into the container.

BACKGROUND

One prior art approach for the production of Xenon gas vials entails evacuating a batch of vials. This batch of vials is then transferred to a loading station where Xenon gas may be dispensed into the pre-evacuated vials one-at-a-time. One problem with this approach is that there may be a reduction in the vacuum within a given vial, prior to the time that the Xenon gas is dispensed into the vial. This may result in a reduced amount of Xenon gas being dispensed into a given vial. This in turn may be a problem to a purchaser of such vials. In at least certain circumstances, this may render the vial not usable for one or more applications.

SUMMARY

A first aspect of the present invention is embodied by a method of producing fluid containers (e.g., a unit dose container, where each such container includes a unit dose of, for instance, fluid such as a gas or combination of gases). A first conveyor is operated to transport (e.g., sequentially, or one-at-a-time) a plurality of containers to a first location where each such container is loaded onto and/or is engaged by a second conveyor. The second conveyor may be operated to transport a container from the first location to a second location. Two operations are conducted on a container that has been transported to the second location by operation of the second conveyor. A first fluid (e.g., air) may be removed from a container while at the second location. A second fluid (e.g., a radioactive fluid, such as Xenon gas) may be dispensed into a container while at the second location after first fluid has first been removed from the container. At some point in time after the completion of at least these two operations, the second conveyor is operated to transport the associated container from the second location to a third location. As such, a container in accordance with the first aspect is transported from the first location to the second location, and some time thereafter is then transported from the second location to a third location (e.g., the second location is somewhere between the first location and the third location).

A number of feature refinements and additional features are applicable to the first aspect of the present invention. These feature refinements and additional features may be used individually or in any combination. The following discussion is applicable to the first aspect, up to the start of the discussion of a second aspect of the present invention. The first conveyor may be of any appropriate configuration, for instance a conveyor belt that when operated transports a plurality of containers along a common axial path. The second conveyor may also be of any appropriate configuration, for instance a turntable that rotates about an axis. Any appropriate drive source may be used for operation of the first conveyor and the second conveyor (e.g., a separate motor for each of the first conveyor and the second conveyor).

Operation of the first conveyor and the second conveyor may be on at least somewhat of a timed basis. Consider the case where both the first conveyor and the second conveyor are indexed or incrementally advanced on some timed basis. The first conveyor may be moved one increment and then maintained in this position, followed by the second conveyor being moved one increment (e.g., 90° about a rotational axis for the second conveyor) and then being maintained in this position, and this may be repeated any appropriate number of times. The incremental movement of the first conveyor may be used to load a new container onto the second conveyor. The subsequent incremental movement of the second conveyor may transport a first container from the first location to the second location.

The second conveyor may include a plurality of container receptacles that are disposed in spaced relation to one another. One embodiment has these container receptacles being on a perimeter of the second conveyor (e.g., in the form of a semi-circular notch or the like). The plurality of container receptacles may be disposed in equally spaced relation about a rotational axis of the second conveyor. One embodiment has the second conveyor including only two container receptacles that are positioned 180° apart relative to a rotational axis of the second conveyor. In this case, one container receptacle may be positioned at the first location and another container receptacle may be positioned at the third location, with the second location being between the first and third locations (e.g., the second location may be 90° from the first location relative to a rotational axis for the second conveyor, and the third location may be 90° from the second location (relative to the rotational axis) such that the first and third locations are 180° apart (relative to the rotational axis)). There may be a fourth location that is between the third location and the first location (e.g., the fourth location being 90° from each of the first location and third location relative to a rotational axis for the second conveyor such that the second and fourth locations are 180° apart). One of the pair of container receptacles may then be positioned at the second location, and the other one of the pair of container receptacles may then be positioned at the fourth location. The second conveyor thereby may be operated to simultaneously dispose the pair of container receptacles at either the first and third locations, or at the second and fourth locations.

As an alternative to the foregoing, the second conveyor could include four equally-spaced container receptacles (e.g., disposed 90° apart relative to a rotational axis of the second conveyor). In this case, a separate container receptacle of the second conveyor could be simultaneously disposed at each of the noted first, second, third, and fourth locations. Operation of the second conveyor in this case may entail moving the second conveyor and then terminating this motion to position a separate container receptacle at each of the first, second, third, and fourth locations.

The second conveyor may be operated to dispose an empty container receptacle at the first location for receipt of a container from the first conveyor. Motion of the second conveyor may be terminated to dispose an empty container receptacle at the first location. Operation of the first conveyor may itself position a container from the first conveyor into the empty container receptacle that has been disposed at the first location by the second conveyor. For instance, motion of the first conveyor may be terminated when a container from the first conveyor has been positioned in an empty container receptacle of the second conveyor, including where part of the first conveyor is disposed directly below the empty container receptacle of the second conveyor at the first location. In any case and at this time, a separate container receptacle of the second conveyor may be disposed at the third location when the second conveyor is stationary and for the case where the second conveyor includes only two container receptacles. When a first container from the first conveyor has been directed onto the second conveyor at the first location, the second conveyor thereafter may be operated to simultaneously: i) transport the first container from the first location to the second location; ii) to transport an empty container receptacle away from the third location (e.g., to a fourth location), for instance after removing a different container from the second conveyor while at the third location.

A first fluid (e.g., air) is removed from a container that is at the second location. One embodiment has this removal including generating a vacuum within the container. Any appropriate negative pressure may be generated within the container at the second location. Removal of the first fluid from a container that is at the second location may include operating one pump (e.g., an evacuation syringe), while the subsequent dispensing of a second fluid into this same container while at this same second location may include operating another pump (e.g., a dispensing syringe). Once the second fluid has been loaded into a container at the second location, the second conveyor is operated to transport this container from the second location to the third location where the second conveyor then stops. The container may be removed from the second conveyor while at the third location, and may be transported in any appropriate manner to one or more additional locations (e.g., using the first conveyor). One of these locations may correspond with an ionization chamber, where a radioactivity content of the container may be measured. Operation of the first conveyor may transport the container from the third location to the ionization chamber. The container also may be disposed in an appropriately shielded container or containment structure (e.g., to at least reduce radiation emissions into the environment based upon the container contents) at some point in time after being transported from the third location as well, for instance after being assayed.

Each of the various containers may include a seal (e.g., a rubber septum, plug, or the like). A dispensing needle may be directed through the seal of a container that is at the second location. This dispensing needle may be used to remove first fluid from the container while at the second location, and thereafter may be used to dispense a second fluid into this same container while still at the second location. One embodiment has both a first pump and a second pump being fluidly connectable with this same dispensing needle through an appropriate valve, such as a diverter valve. The diverter valve may be disposed in a second position to fluidly connect the second pump with the dispensing needle for the removal of first fluid from a container while at the second location. The diverter valve may be disposed in a first position to fluidly connect the first pump with the dispensing needle for the subsequent dispensing of second fluid into this same container while remaining at the second location. The diverter valve thereafter may be disposed back in its second position and a third fluid may be dispensed into the same container through the same dispensing needle and while this container remains at the second location. The dispensing of the third fluid into the container at the second location may include realizing atmospheric pressure within the container. One embodiment has this third fluid being air, including atmospheric air that is first passed through a filter prior to being directed into the container while at the second location.

A second aspect of the present invention is embodied by a system for producing fluid containers (e.g., a unit dose container, where each such container includes a unit dose of, for instance, fluid such as a gas or combination of gases). A first conveyor is operable to sequentially transport a plurality of containers to a first location (e.g., to dispose one container at the first location, and some time thereafter to dispose another container at this same first location). A second conveyor comprises a plurality of container receptacles that are disposed in spaced relation to one another. This second conveyor is operable to sequentially position a given container receptacle at the first location, then at a second location, and then at a third location, where the first, second, and third locations are spaced from one another (e.g., with the second location being somewhere between the first and third locations). This same sequence may apply to each container receptacle used by the second conveyor. In any case, a dispensing needle is aligned with the second location. An actuator is operable to advance the dispensing needle relative to a container when disposed in one of the container receptacles of the second conveyor and while this container is at the noted second location. A vacuum source is fluidly connectable with the dispensing needle, as well as a fluid source.

A number of feature refinements and additional features are applicable to the second aspect of the present invention. These feature refinements and additional features may be used individually or in any combination. The following discussion is applicable to at least the second aspect. The vacuum source may be in the form of one pump (e.g., an evacuation syringe), and the fluid source may be in the form of another pump (e.g., a dispensing syringe). The first and second conveyors for the second aspect may be as addressed above in relation to the first aspect.

Any feature of any other various aspects of the present invention that is intended to be limited to a "singular" context or the like will be clearly set forth herein by terms such as "only," "single," "limited to," or the like. Merely introducing a feature in accordance with commonly accepted antecedent basis practice does not limit the corresponding feature to the singular. Moreover, any failure to use phrases such as "at least one" also does not limit the corresponding feature to the singular. Use of the phrase "at least generally" or the like in relation to a particular feature encompasses the corresponding characteristic and insubstantial variations thereof. Finally, a reference of a feature in conjunction with the phrase "in one embodiment" does not limit the use of the feature to a single embodiment. One particularly desirable application of the present invention pertains to unit dose containers for radioactive fluids. Various radioactive fluids may be dispensed into containers at the second location and in accordance with the present invention, including one or more unstable isotopes of Xenon, and further including Xenon in the form of a gas.

Various aspects of the present invention are also addressed by the following paragraphs and in the noted combinations:

1. A method of producing unit dose containers of radioactive fluid, comprising the steps of: a first operating step comprising operating a first conveyor to sequentially transport a plurality of containers to a first location;

loading each container of said plurality of containers, that is transported to said first location by said first conveyor, onto a second conveyor;

a second operating step comprising operating said second conveyor to transport said container, that is currently at said first location, from said first location to a second location;

removing a first fluid from said container that is currently at said second location;

dispensing a second fluid into said container that is currently at said second location, wherein said dispensing step is executed after said removing step, and wherein said second fluid is radioactive; and said second operating step further comprising operating said second conveyor to transport said container, that is currently at said second location, from said second location to a third location.

2. The method of paragraph 1, wherein said operating a first conveyor step comprises advancing each said container of said plurality of containers along a common axial path.

3. The method of any of paragraphs 1-2, wherein said second operating step comprise rotating said second conveyor.

4. The method of any of paragraphs 1-3, wherein said second conveyor comprises a rotatable turntable.

5. The method of any of paragraphs 1-4, wherein said second conveyor comprises a plurality of container receptacles that are disposed in spaced relation to one another, wherein an empty container receptacle of said plurality of container receptacles is at said first location for each execution of said loading step.

6. The method of paragraph 5, wherein when a first container of said plurality of containers is in a first container receptacle of said plurality of receptacles and is disposed at said first location, a second container receptacle of said plurality of receptacles is disposed at said third location.

7. The method of paragraph 6, wherein said second operating step further comprises operating said second conveyor to simultaneously:

transport said first container from said first location to said second location; and transport said second container receptacle away from said third location and in a direction of said first location.

8. The method of paragraph 7, wherein said first conveyor comprises extending at least from said first location to at least to said third location.

9. The method of paragraph 8, wherein a second container of said plurality of containers is in said second container receptacle of said second conveyor when said second container receptacle is at said third location, said method further comprising:

transporting said second container away from said third location prior to transporting said first container from said first location to said second location using said second conveyor; and measuring a radioactivity content of said second container after being transported away from said third location.

10. The method of any of paragraphs 7-9, wherein each said container of said plurality of containers comprises a seal, said method further comprising:

directing a dispensing needle through said seal of said first container while at said second location, wherein said removing step and said dispensing step, for said first container that is currently at said second location, are each executed through said dispensing needle and after said directing step associated with said first container.

11. The method of paragraph 10, wherein a first pump and a second pump are each fluidly connectable with said dispensing needle through a diverter valve, said method further comprising:

disposing said diverter valve in a second position to fluidly connect said second pump with said dispensing needle for execution of said removing a first fluid step for said first container while at said second location; and disposing said diverter valve in a first position to fluidly connect said first pump with said dispensing needle for execution of said dispensing a second fluid step for said first container while at said second location.

12. The method of paragraph 11, further comprising:

returning said diverter valve from said first position back to said second position after said dispensing a second fluid step for said first container while at said second location; and directing a third fluid into said container, through said dispensing needle, and after said returning step for said first container while at said second location.

13. The method of paragraph 12, wherein said directing a third fluid step for said first container while at said second location comprises realizing atmospheric pressure within said first container.

14. The method of any of paragraphs 12-13, wherein said first fluid that is removed from said first container while at said second location is air, and wherein said third fluid that is directed into said first container while at said second location is air.

15. The method of any of paragraphs 12-14, wherein said directing a third fluid step comprises passing air through a filter prior to entering said dispensing needle for provision to said first container while at said second location.

16. The method of any of paragraphs 7-15, wherein said second operating step comprises maintaining said second conveyor in a stationary position with said first container being at said first location and with said second container receptacle being at said third location.

17. The method of any of paragraphs 6-16, wherein said second operating step comprises moving said second conveyor in predetermined increments where said second conveyor is stationary between each incremental movement of said second conveyor, wherein said first container is at said second location and said second container receptacle is at a fourth location after one said incremental movement of said second conveyor, wherein said first, second, third, and fourth locations are spaced from one another and in this order proceeding about a rotational axis of said second conveyor.

18. The method of any of paragraphs 1-5, wherein said removing a first fluid step comprises generating a vacuum within said container while at said second location.

19. The method of any of paragraphs 1-5 and 18, wherein said removing a first fluid step comprises removing air from said container while at said second location.

20. The method of any of paragraphs 1-5, 18, and 19, wherein said removing a first fluid step comprises operating one pump, and wherein said dispensing a second fluid step comprises operating another pump.

21. The method of any of paragraphs 1-5 and 18-20, wherein said dispensing a second fluid step comprises dispensing xenon gas into said container that is currently at said second location.

22. The method of any of paragraphs 1-5 and 18-21, wherein each said container of said plurality of containers comprises a seal, said method further comprising:

directing a dispensing needle through said seal of said container that is currently at said second location, wherein said removing step and said dispensing step, for said container that is currently at said second location, are each executed through said dispensing needle and after said directing step.

23. The method of paragraph 22, wherein a first pump and a second pump are each fluidly connectable with said dispensing needle through a diverter valve, said method further comprising:

disposing said diverter valve in a second position to fluidly connect said second pump with said dispensing needle for execution of said removing a first fluid step; and disposing said diverter valve in a first position to fluidly connect said first pump with said dispensing needle for execution of said dispensing a second fluid step.

24. The method of paragraph 23, further comprising:

returning said diverter valve from said first position back to said second position after said dispensing a second fluid step; and directing a third fluid into said container, through said dispensing needle, and after said returning step.

25. The method of paragraph 24, wherein said directing a third fluid step comprises realizing atmospheric pressure within said container.

26. The method of any of paragraphs 24-25, wherein said first fluid that is removed from said container that is currently at said second location is air, and wherein said third fluid that is directed into said container that is currently at said second location is air.

27. The method of any of paragraphs 24-26, wherein said directing a third fluid step comprises passing air through a filter prior to entering said dispensing needle for provision to said container that is currently at said second location.

28. The method of any of paragraphs 1-5 and 18-27, wherein said second operating step comprises transporting said container from said second location to said third location.

29. The method of paragraph 28, further comprising: measuring a radioactivity content of said container at some point in time after said container has been transported to said third location.

30. The method of paragraph 29, further comprising:

disposing said container in a shielded container after said measuring step.

31. The method of any of paragraphs 1-29, further comprising:

disposing each said container in its own shielded transport container at some point in time after execution of its corresponding said dispensing a second fluid step.

32. The method of any of paragraphs 1-5 and 18-31, wherein said second operating step comprises moving said second conveyor in predetermined increments where said second conveyor is stationary between each incremental movement of said second conveyor.

33. A system for producing unit dose containers of radioactive fluid, comprising:

a first conveyor operable to sequentially transport a plurality of containers to a first location;

a second conveyor comprising a plurality of container receptacles that are disposed in spaced relation to one another, wherein said second conveyor is operable to sequentially position a given container receptacle of said plurality of container receptacles at each of said first location, a second location, and a third location, wherein said first, second, and third locations are spaced from one another;

a dispensing needle aligned with said second location;

an actuator that is operable to advance said dispensing needle relative to a container when disposed in one of said container receptacles of said second conveyor and while at said second location;

a vacuum source fluidly connectable with said dispensing needle; and a radioactive fluid source fluidly connectable with said dispensing needle.

34. The system of paragraph 33, wherein said first conveyor is a linear conveyor.

35. The system of any of paragraphs 33-34, wherein said second conveyor is a rotatable turntable.

36. The system of any of paragraphs 33-35, wherein said actuator is a linear actuator that is operable to move said dispensing needle in a first direction and in a second direction that is opposite of the first direction.

37. The system of any of paragraphs 33-36, wherein said vacuum source comprises a pump.

38. The system of any of paragraphs 33-37, wherein said vacuum source comprises an evacuation syringe.

39. The system of any of paragraphs 33-38, wherein said radioactive fluid source comprises a pump.

40. The system of any of paragraphs 33-39, wherein said radioactive fluid source comprises a dispensing syringe.

41. The system of any of paragraphs 33-40, further comprising a diverter valve disposed between said dispensing needle and each of said vacuum source and said radioactive fluid source.

42. The system of paragraph 41, wherein said diverter valve is disposable in a first position to allow fluid communication between said radioactive fluid source and said dispensing needle, and wherein said diverter valve is disposable in a second position to allow fluid communication between said vacuum source and said dispensing needle.

43. The system of paragraph 42, wherein said diverter valve is also disposable in said second position to allow fluid communication between an atmospheric air source and said dispensing needle, said system further comprising a filter between said atmospheric air source and said dispensing needle.

44. The system of any of paragraphs 33-43, wherein said first conveyor extends at least from said first location to said third location.

DETAILED DESCRIPTION

Figure 1:
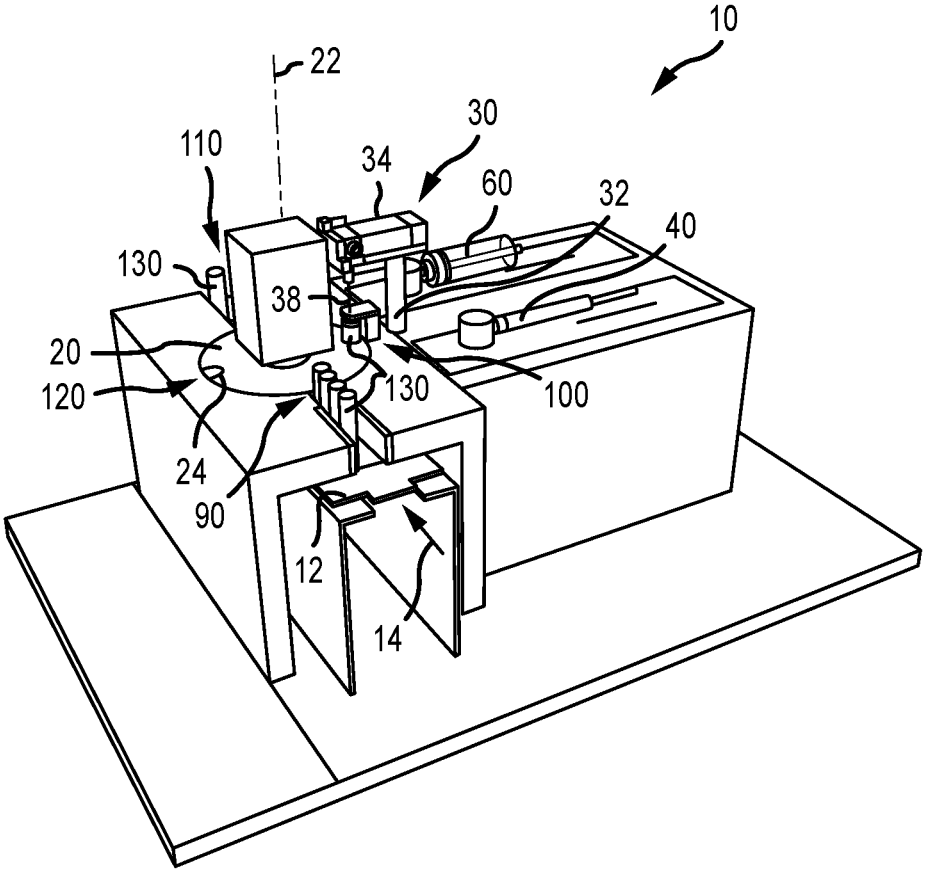
FIG. 1 is a perspective view of one embodiment of a unit dose container production system for radioactive fluids.

One embodiment of a unit dose container production system is illustrated in FIG. 1 and is identified by reference numeral 10. The production system 10 includes a first conveyor 12 and a second conveyor 20 (in the form of a turntable for the illustrated embodiment). The first conveyor 12 transports (e.g., sequentially) a plurality of unit dose containers 130 to the second conveyor 20. The second conveyor 20 transports (e.g., sequentially) containers 130 to a number of different locations, where at least one operation may be undertaken at a given location.

Figure 2:
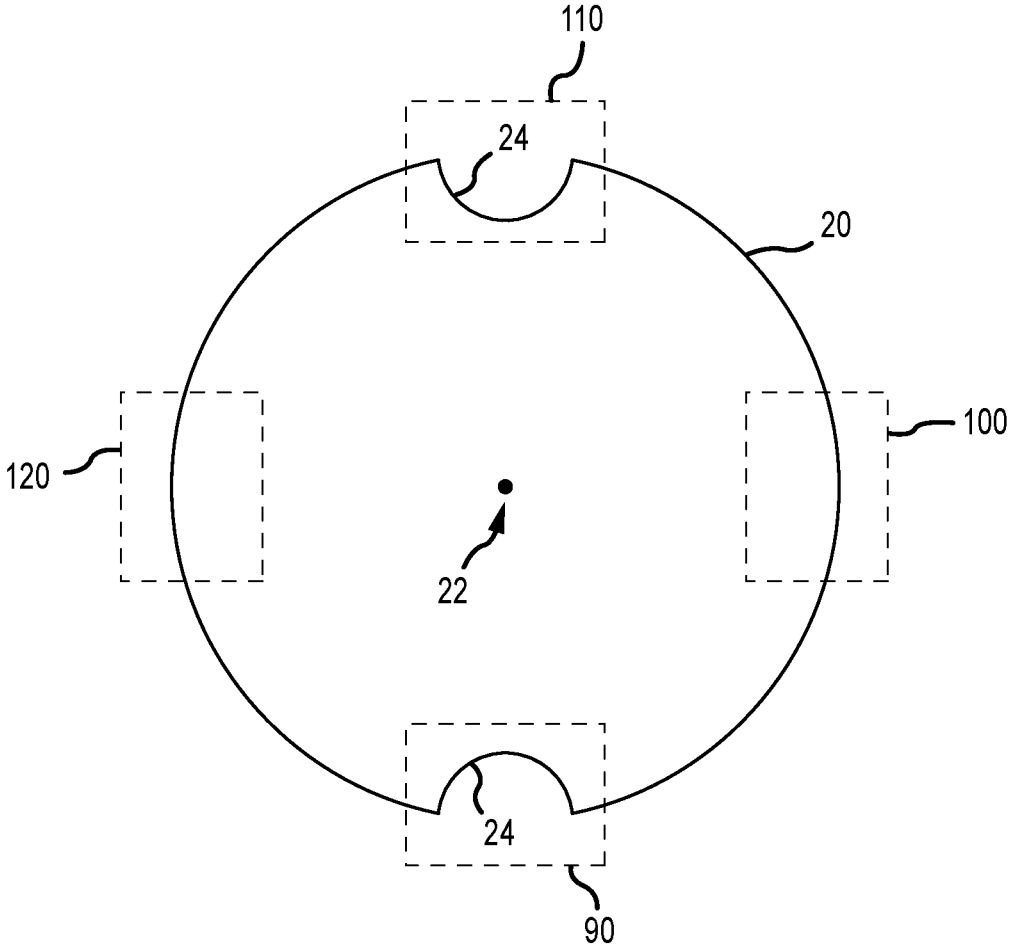
FIG. 2 is a top or plan view of a turntable that is used by the unit dose container production system of FIG. 1, and that illustrates a plurality of different locations where a unit dose container may be sequentially positioned for execution of one or more operations.

The first conveyor 12 may be of any appropriate type, for instance in the form of a conveyor belt that transports the unit dose containers 130 at least generally along an axial or linear path 14 (e.g., advanced by operation of an appropriate drive source, such as a motor). As noted, the second conveyor 20 is in the form of a turntable for the illustrated embodiment, and is rotatable about a rotational axis 22 (e.g., by operation of an appropriate drive source, such as a motor). A plurality of container receptacles 24 are incorporated by the second conveyor 20 (FIGS. 1 and 2). In the illustrated embodiment, each container receptacle 24 is incorporated on a perimeter of the second conveyor 20, and the container receptacles 24 are disposed in equally-spaced relation about/relative to the rotational axis 22 (180° apart in the illustrated embodiment). There are two container receptacles 24 in the illustrated embodiment, although any appropriate number of container receptacles 24 may be utilized.

The first conveyor 12 may be characterized as sequentially transporting a plurality of unit dose containers 130 to a first location 90. This first location 90 may be characterized as a loading station where a unit dose container 130 from the first conveyor 12 is directed into an empty one of the container receptacles 24 of the second conveyor 20 (an empty container receptacle 24 that is at the first location 90). In this regard, part of the first conveyor 12 may be disposed directly below the second conveyor 20 at the first location 90. Rotation of the second conveyor 20 may be terminated once one of its empty container receptacles 24 is appropriately aligned with the axial path 14 along which the unit dose containers 130 are being advanced by the first conveyor 12 (i.e., to position such an empty container receptacle 24 at the first location 90, and typically while the second conveyor 20 remains stationary). Operation of the first conveyor 12 may then directly position a unit dose container 130 into an empty container receptacle 24 that is at the first location 90 (i.e., a separate "transfer apparatus" is not required). As at least part of the first conveyor 12 extends under the second conveyor 20 at the first location 90, motion of the first conveyor 12 may be terminated to align one if its containers 130 with the empty container receptacle 24 of the second conveyor 20 that is at the first location 90.

The second conveyor 20 may be operated to move a unit dose container 130 from the first location 90 to a second location 100 (FIGS. 1 and 2), and where movement of the second conveyor 20 is then terminated. The second location 100 may be characterized as an evacuation/dispensing station. An evacuation/dispensing system 30 may be operated to evacuate fluid from a unit dose container 130 that is that the second location 100, and furthermore may be operated to thereafter dispense an appropriate fluid into the unit dose container 130 while still at the second location 100. That is, rotation of the second conveyor 20 may be terminated when a unit dose container 130 has been transported from the first location 90 to the second location 100, and during which time the second conveyor 20 remains stationary for execution of the noted operations.

Figure 3:
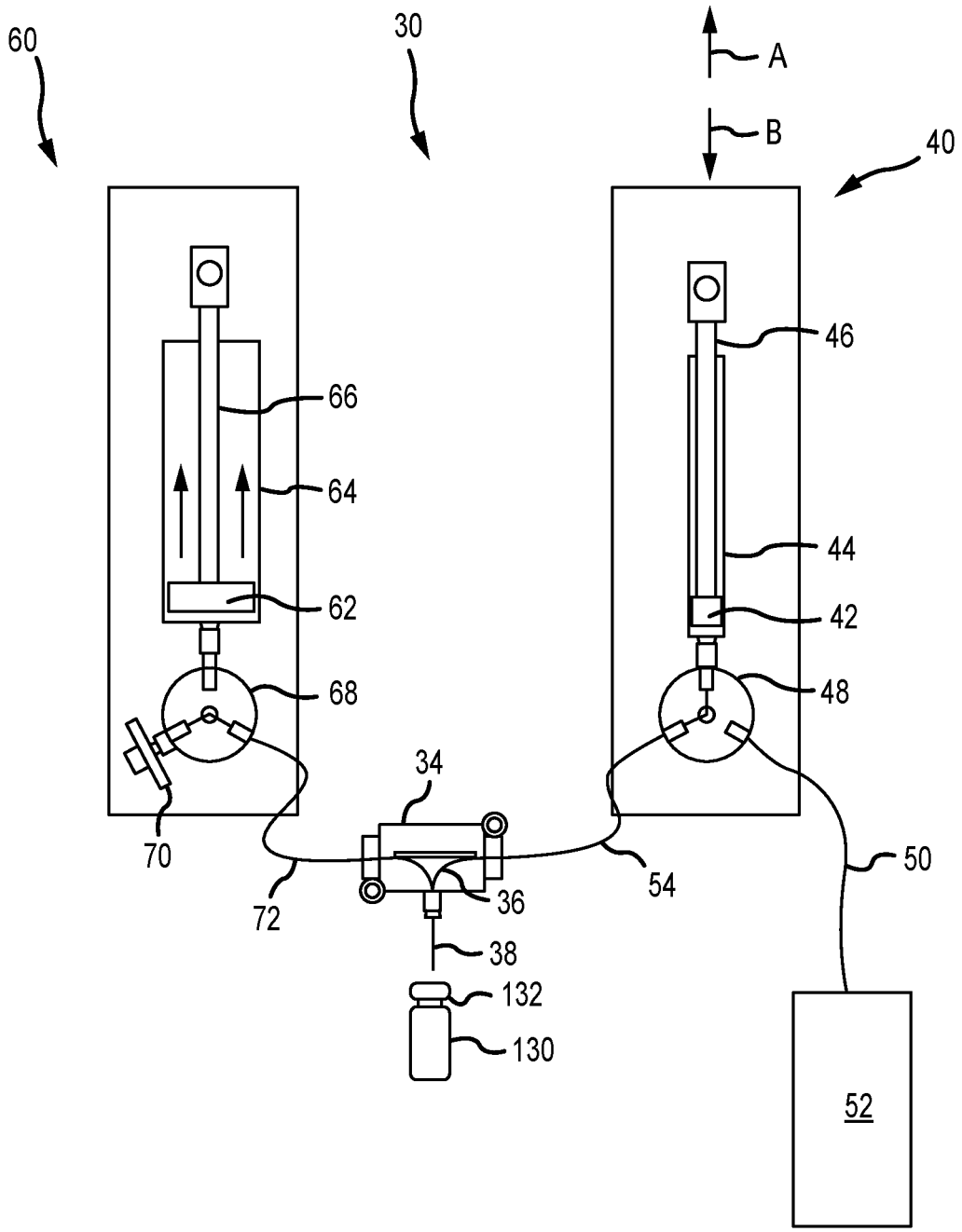
FIG. 3 is a schematic of an evacuation/dispensing system used by the unit dose container production system of FIG. 1.

Details regarding an embodiment of the evacuation/dispensing system 30 are illustrated in both FIG. 1 and FIG. 3. The evacuation/dispensing system includes a linear actuator 32 for advancing a dispensing needle 38 along an axial path, namely to direct the dispensing needle 38 through a seal 132 of a unit dose container 130 that is positioned at the second location 100, and to thereafter to retract the dispensing needle 38 away from the unit dose container 130 such that the second conveyor 20 may be operated to transport the unit dose container 130 from the second location 100 to a third location 110 (FIGS. 1 and 2). The dispensing needle 38 extends from a manifold 34 that is advanced by the linear actuator 32. A diverter or manifold valve 36 may be moved between two different positions to provide two different flowpaths through the manifold 34.

Two different operations are executed while a unit dose container 130 is at the second location 100, and with the noted dispensing needle 38 having been directed through the seal 132 of this unit dose container 130 such that dispensing needle 38 is in fluid communication with the interior storage space of this particular unit dose container 130. First, fluid is evacuated from the interior storage space of the unit dose container 130 (that is positioned at the second location 100, and with the second conveyor 20 being stationary) by operation of an evacuation syringe 60 of the evacuation/dispensing system 30 (and where the diverter valve 36 for the manifold 34 has been moved to a position where the manifold 34 is in fluid communication with the evacuation syringe 60 via evacuation tubing 72). Thereafter, a radioactive fluid is dispensed into the interior storage space of the unit dose container 130 (that is positioned at the second location 100, and with the second conveyor 20 being stationary) by operation of a dispensing syringe 40 of the evacuation/dispensing system 30 (where the diverter valve 36 for the manifold 34 has been moved to another position where the manifold 34 is now in fluid communication with the dispensing syringe 40 via tubing 54).

The evacuation syringe 60 may include a piston 62 that is disposed within a cylinder 64 and that is advanced along an axial path (e.g., by a shaft 66 and/or operation of an appropriate motor or other drive source, for instance a servo motor). A multi-port or multi-flow channel valve 68 is utilized by the evacuation syringe 60 to provide separate and distinct flowpaths. When the valve 68 for the evacuation syringe 60 is in one position (and with the diverter valve 36 for the manifold being positioned to allow fluid to flow from the dispensing needle 38, through the manifold 34, and to the evacuation tubing 72), the cylinder 64 of the evacuation syringe 60 is then in fluid communication with the interior storage space of the unit dose container 130 (that is positioned at the second location 100) by the evacuation tubing 72 that extends between the evacuation syringe 60 and the manifold 34. At this time, the evacuation syringe 60 may be operated to move the piston 62 in the direction shown by the arrows in FIG. 3. Fluid (e.g., air) will thereby be withdrawn out of the unit dose container 130 (that is at the second location 100), through the manifold 34, through the evacuation tubing 72, and into the cylinder 64 of the evacuation syringe 60. This creates a vacuum (i.e., a negative pressure) within the unit dose container 130 that is at the second location 100.

The dispensing syringe 40 may include a piston 42 that is disposed within a cylinder 44 and that is advanced along an axial path (e.g., by a shaft 46 and/or operation of an appropriate motor or other drive source). A multi-port or multi-flow channel valve 48 is utilized by the dispensing syringe 40 to provide to provide separate and distinct flowpaths. When the valve 48 for the dispensing syringe 40 is in one position, the cylinder 44 of the dispensing syringe 40 is in fluid communication a radioactive fluid source 52 (e.g., one or more unstable isotopes of Xenon gas) by tubing 50. Radioactive fluid may then be transferred from the radioactive fluid source 52 to the cylinder 44 of the dispensing syringe 40 (e.g., by moving the piston 48 in the direction of arrow A in FIG. 3). At this time, the dispensing syringe 40 is fluidly isolated from both the unit dose container 130 (that is at the second location 100) and the evacuation syringe 60.

After the unit dose container 130 (that is at the second location 100) has been evacuated in the above-noted manner by the evacuation syringe 60, radioactive fluid may be transferred from the dispensing syringe 40 to this unit dose container 130. In this regard, the diverter valve 36 for the manifold 34 may be moved to a position where the diverter valve 36 now allows fluid communication between the tubing 54 and the dispensing needle 38. The valve 48 for the dispensing syringe 40 is moved to a position where the cylinder 44 of the evacuation syringe 60 is now in fluid communication with the tubing 54. As such and with the diverter valve 36 (manifold 34) and the valve 48 (dispensing syringe 40) being in the noted positions, the dispensing syringe 40 may be operated to move the piston 42 in the direction shown by the arrow B in FIG. 3. Radioactive fluid will thereby be dispensed into the unit dose container 130 (that is at the second location 100), namely by flowing from the cylinder 44 of the dispensing syringe 40, through the tubing 54, through the manifold 34, through the dispensing needle 38, and into the interior storage space of this unit dose container 130. At this time, the dispensing syringe 40 is fluidly isolated from both the fluid source 50 and the evacuation syringe 60.

After fluid has been evacuated from the unit dose container 130, and after radioactive fluid has thereafter been dispensed into this evacuated unit dose container 130 (all with this unit dose container 130 remaining at the second location 100): 1) the diverter valve 36 for the manifold 34 may be moved back to a position where the dispensing needle 38 and the evacuation tubing 72 are once again in fluid communication; and 2) the valve 68 for the evacuation syringe 60 may be moved to a position where the evacuation tubing 72 is now in fluid communication with a filtered vent 70. Fluid (e.g., atmospheric air) may then flow through the evacuation tubing 72, through the manifold 34, through the dispensing needle 38, and into the interior storage space of the unit dose container 130 (that remains at the second location 100, by the second conveyor 20 remaining stationary). The unit dose container 130 should thereby have a "charge" of radioactive fluid, along with a quantity of atmospheric air to realize atmospheric pressure within the unit dose container 130. The piston 62 of the evacuation syringe 60 may be returned to the position shown in FIG. 3 at any appropriate time (e.g., for an evacuation operation of another unit dose container 130 that is transported to the second location 100 by operation of the second conveyor 20).

The second conveyor 20 may be operated to transport a unit dose container 130 from the second location 100 (after having been evacuated and thereafter having radioactive fluid dispensed therein pursuant to the foregoing) to the third location 110 where motion of the second conveyor 20 is then terminated. The unit dose container 130 may be positioned back on the first conveyor 12 at the third location 110, and the first conveyor 12 may be operated to remove the unit dose container 130 from its container receptacle 24 while at the third location 110 and to transport the unit dose container 130 to an ionization chamber (not shown). The radioactivity content of a unit dose container 130 may be determined through operation of the ionization chamber in a manner known in the art. Ultimately the unit dose container 130 may be removed from the second conveyor 20 while at the third location 110 and in any appropriate manner, and thereafter may be transported in any appropriate manner to at least one other location, such as an ionization chamber and/or for disposition in a shielded transport container or the like (e.g., a container with shielding that substantially blocks at least certain radiation emissions into the environment).

Each of the first conveyor 12 and the second conveyor 20 may be indexed or moved an incremental amount and on a timed basis. Generally, the first conveyor 12 and the second conveyor 20 may be operated such that when one of the first conveyor 12 and the second conveyor 20 is undergoing an indexed movement (e.g., moved an incremental amount and after which its motion is terminated), the other of the first conveyor 12 and the second conveyor 20 may be maintained in a stationary state or condition.

The illustrated embodiment uses a second conveyor 20 with two container receptacles 24 that are disposed 180° apart. At startup, each of the two container receptacles 24 of the second conveyor 20 will be empty. At this time, a first unit dose container 130 may be transported by the first conveyor 12 to an empty container receptacle 24 that is at the first location 90 (and while the second conveyor 20 is stationary). The other of the container receptacles 24 will be positioned at the third location 110 at this time, and will typically be in an empty condition or state at startup. The noted loading of a unit dose container 130 into a container receptacle 24 of the second conveyor 20 (where this container receptacle 24 is at the first location 90) again may be via an indexed movement of the first conveyor 12—the first conveyor 12 may be moved an incremental amount and then its motion may be terminated. The second conveyor 20 thereafter may be operated to move the first unit dose container 130 from the first location 90 to the second location 100 (e.g., 90° about the rotational axis 22) where motion of the second conveyor 20 is then terminated, and that also simultaneously disposes the other empty container receptacle 24 of the second conveyor 20 at a fourth location 120 that is part-way (e.g., half-way or 90° about the rotational axis 22) between the third location 110 and the first location 90, and all of which may be provided by an indexed movement of the second conveyor 20—the second conveyor 20 may be moved an incremental amount (e.g., 90° about the rotational axis 22) and then its motion may be terminated.

Once the first unit dose container 130 at the second location 100 has been evacuated and "loaded" with radioactive fluid in the above-noted manner, the second conveyor 20 may then be operated (e.g., another indexed movement of the second conveyor 20—the second conveyor 20 may be moved an incremental amount (e.g., 90° about the rotational axis 22) and then its motion may be terminated) to simultaneously: 1) move the first unit dose container 130 from the second location 100 to the third location 110; and 2) move an empty container receptacle 24 of the second conveyor 20 from the fourth location 120 to the first location 90. Thereafter, the first conveyor 12 may then again be operated to direct another unit dose container 130 into the empty container receptacle 24 at the first location 90 (e.g., another indexed movement of the first conveyor 12—the first conveyor 12 may be moved an incremental amount and then its motion may be terminated). The first unit dose container 130 may be removed from the second conveyor 20 at the third location 110 in any appropriate manner, and thereafter may be transported in any appropriate manner to one or more other locations as noted above. For instance, a unit dose container 130 that is removed from the second conveyor 20 at the third location 110 may be transported in any appropriate manner to one or more locations and in any order, for instance to an ionization chamber where its radioactivity content may be determined and/or to a location where the unit dose container 130 is positioned in a shielded transport container or the like (e.g., a container with shielding that substantially blocks at least certain radiation emissions into the environment). The general process of this paragraph may be repeated any appropriate number of times.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed:

1. A method of producing unit dose containers of radioactive fluid, comprising the steps of:

a first operating step comprising operating a first conveyor to sequentially transport a plurality of containers to a first location;

loading each container of said plurality of containers, that is transported to said first location by said first conveyor, onto a second conveyor;

a second operating step comprising operating said second conveyor to transport said container, that is currently at said first location, from said first location to a second location;

removing a first fluid from said container that is currently at said second location;

dispensing a second fluid into said container that is currently at said second location, wherein said dispensing step is executed after said removing step, and wherein said second fluid is radioactive; and said second operating step further comprising operating said second conveyor to transport said container, that is currently at said second location, from said second location to a third location, wherein said removing a first fluid step comprises generating a vacuum within said container while at said second location, wherein said removing a first fluid step comprises removing air from said container while at said second location, and wherein said dispensing a second fluid step comprises dispensing xenon gas into said container that is currently at said second location.

2. The method of claim 1, wherein said operating a first conveyor step comprises advancing each said container of said plurality of containers along a common axial path, and wherein said second operating step comprise rotating said second conveyor.

3. The method of claim 1, wherein said second conveyor comprises a plurality of container receptacles that are disposed in spaced relation to one another, and wherein an empty container receptacle of said plurality of container receptacles is at said first location for each execution of said loading step.

4. The method of claim 3, wherein when a first container of said plurality of containers is in a first container receptacle of said plurality of receptacles and is disposed at said first location, a second container receptacle of said plurality of receptacles is disposed at said third location, and wherein said second operating step further comprises operating said second conveyor to simultaneously:

transport said first container from said first location to said second location; and transport said second container receptacle away from said third location and in a direction of said first location.

5. The method of claim 4, wherein said first conveyor comprises extending at least from said first location to at least to said third location, and wherein a second container of said plurality of containers is in said second container receptacle of said second conveyor when said second container receptacle is at said third location, said method further comprising:

transporting said second container away from said third location prior to transporting said first container from said first location to said second location using said second conveyor; and measuring a radioactivity content of said second container after being transported away from said third location.

6. The method of claim 1, wherein said removing a first fluid step comprises operating one pump, and wherein said dispensing a second fluid step comprises operating another pump.

7. The method of claim 1, wherein each said container of said plurality of containers comprises a seal, said method further comprising:

directing a dispensing needle through said seal of said container that is currently at said second location, wherein said removing step and said dispensing step, for said container that is currently at said second location, are each executed through said dispensing needle and after said directing step.

8. The method of claim 7, wherein a first pump and a second pump are each fluidly connectable with said dispensing needle through a diverter valve, said method further comprising:

disposing said diverter valve in a second position to fluidly connect said second pump with said dispensing needle for execution of said removing a first fluid step; and disposing said diverter valve in a first position to fluidly connect said first pump with said dispensing needle for execution of said dispensing a second fluid step.

9. The method of claim 8, further comprising:

returning said diverter valve from said first position back to said second position after said dispensing a second fluid step; and directing a third fluid into said container, through said dispensing needle, and after said returning step.

10. The method of claim 9, wherein said first fluid that is removed from said container that is currently at said second location is air, and wherein said directing a third fluid step comprises passing air through a filter prior to entering said dispensing needle for provision to said container that is currently at said second location.

11. The method of claim 1, further comprising:

measuring a radioactivity content of said container at some point in time after said container has been transported to said third location; and disposing each said container in its own shielded transport container at some point in time after execution of its corresponding said dispensing a second fluid step.

12. The method of claim 1, wherein said second operating step comprises moving said second conveyor in predetermined increments where said second conveyor is stationary between each incremental movement of said second conveyor.

13. A system for producing unit dose containers of radioactive fluid, comprising:

a first conveyor operable to sequentially transport a plurality of containers to a first location;

a second conveyor comprising a plurality of container receptacles that are disposed in spaced relation to one another, wherein said second conveyor is operable to sequentially position a given container receptacle of said plurality of container receptacles at each of said first location, a second location, and a third location, wherein said first, second, and third locations are spaced from one another;

a dispensing needle aligned with said second location;

an actuator that is operable to advance said dispensing needle relative to a container when disposed in one of said container receptacles of said second conveyor and while at said second location;

a vacuum source fluidly connectable with said dispensing needle; and a radioactive fluid source fluidly connectable with said dispensing needle;

wherein at least one of said vacuum source and said radioactive fluid source comprises a syringe.

14. The system of claim 13, wherein said first conveyor is a linear conveyor.

15. The system of claim 13, wherein said second conveyor is a rotatable turntable.

16. The system of claim 13, wherein said actuator is a linear actuator that is operable to move said dispensing needle in a first direction and in a second direction that is opposite of the first direction.

17. The system of claim 13, wherein said vacuum source comprises an evacuation syringe.

18. The system of claim 13, wherein said radioactive fluid source comprises a dispensing syringe.

19. The system of claim 13, further comprising a diverter valve disposed between said dispensing needle and each of said vacuum source and said radioactive fluid source.

20. The system of claim 19, wherein said diverter valve is disposable in a first position to allow fluid communication between said radioactive fluid source and said dispensing needle, and wherein said diverter valve is disposable in a second position to allow fluid communication between said vacuum source and said dispensing needle.

21. The system of claim 20, wherein said diverter valve is also disposable in said second position to allow fluid communication between an atmospheric air source and said dispensing needle, said system further comprising a filter between said atmospheric air source and said dispensing needle.

22. The system of claim 13, wherein said first conveyor extends at least from said first location to said third location.

23. A method of producing unit dose containers of radioactive fluid, comprising the steps of:

a first operating step comprising operating a first conveyor to sequentially transport a plurality of containers to a first location;

loading each container of said plurality of containers, that is transported to said first location by said first conveyor, onto a second conveyor;

a second operating step comprising operating said second conveyor to transport said container, that is currently at said first location, from said first location to a second location;

removing a first fluid from said container that is currently at said second location;

dispensing a second fluid into said container that is currently at said second location, wherein said dispensing step is executed after said removing step, and wherein said second fluid is radioactive;

said second operating step further comprising operating said second conveyor to transport said container, that is currently at said second location, from said second location to a third location;

measuring a radioactivity content of said container at some point in time after said container has been transported to said third location; and disposing each said container in its own shielded transport container at some point in time after execution of its corresponding said dispensing a second fluid step.

24. The method of claim 23, wherein said operating a first conveyor step comprises advancing each said container of said plurality of containers along a common axial path, and wherein said second operating step comprise rotating said second conveyor.

25. The method of claim 23, wherein said second conveyor comprises a plurality of container receptacles that are disposed in spaced relation to one another, and wherein an empty container receptacle of said plurality of container receptacles is at said first location for each execution of said loading step.

26. The method of claim 25, wherein when a first container of said plurality of containers is in a first container receptacle of said plurality of receptacles and is disposed at said first location, a second container receptacle of said plurality of receptacles is disposed at said third location, and wherein said second operating step further comprises operating said second conveyor to simultaneously:

transport said first container from said first location to said second location; and transport said second container receptacle away from said third location and in a direction of said first location.

27. The method of claim 26, wherein said first conveyor comprises extending at least from said first location to at least to said third location, and wherein a second container of said plurality of containers is in said second container receptacle of said second conveyor when said second container receptacle is at said third location, said method further comprising:

transporting said second container away from said third location prior to transporting said first container from said first location to said second location using said second conveyor; and measuring a radioactivity content of said second container after being transported away from said third location.

28. The method of claim 23, wherein said removing a first fluid step comprises operating one pump, and wherein said dispensing a second fluid step comprises operating another pump.

29. The method of claim 23, wherein each said container of said plurality of containers comprises a seal, said method further comprising:

directing a dispensing needle through said seal of said container that is currently at said second location, wherein said removing step and said dispensing step, for said container that is currently at said second location, are each executed through said dispensing needle and after said directing step.

30. The method of claim 29, wherein a first pump and a second pump are each fluidly connectable with said dispensing needle through a diverter valve, said method further comprising:

disposing said diverter valve in a second position to fluidly connect said second pump with said dispensing needle for execution of said removing a first fluid step; and disposing said diverter valve in a first position to fluidly connect said first pump with said dispensing needle for execution of said dispensing a second fluid step.

31. The method of claim 30, further comprising:

returning said diverter valve from said first position back to said second position after said dispensing a second fluid step; and directing a third fluid into said container, through said dispensing needle, and after said returning step.

32. The method of claim 31, wherein said first fluid that is removed from said container that is currently at said second location is air, and wherein said directing a third fluid step comprises passing air through a filter prior to entering said dispensing needle for provision to said container that is currently at said second location.

33. The method of claim 23, wherein said second operating step comprises moving said second conveyor in predetermined increments where said second conveyor is stationary between each incremental movement of said second conveyor.

34. A system for producing unit dose containers of radioactive fluid, comprising:

a first conveyor operable to sequentially transport a plurality of containers to a first location;

a second conveyor comprising a plurality of container receptacles that are disposed in spaced relation to one another, wherein said second conveyor is operable to sequentially position a given container receptacle of said plurality of container receptacles at each of said first location, a second location, and a third location, wherein said first, second, and third locations are spaced from one another, wherein said first conveyor extends at least from said first location to said third location;

a dispensing needle aligned with said second location;

an actuator that is operable to advance said dispensing needle relative to a container when disposed in one of said container receptacles of said second conveyor and while at said second location;

a vacuum source fluidly connectable with said dispensing needle; and a radioactive fluid source fluidly connectable with said dispensing needle.

35. The system of claim 34, wherein said first conveyor is a linear conveyor.

36. The system of claim 34, wherein said second conveyor is a rotatable turntable.

37. The system of claim 34, wherein said actuator is a linear actuator that is operable to move said dispensing needle in a first direction and in a second direction that is opposite of the first direction.

38. The system of claim 34, wherein said vacuum source comprises a pump.

39. The system of claim 34, wherein said vacuum source comprises an evacuation syringe.

40. The system of claim 34, wherein said radioactive fluid source comprises a pump.

41. The system of claim 34, wherein said radioactive fluid source comprises a dispensing syringe.

42. The system of claim 34, further comprising a diverter valve disposed between said dispensing needle and each of said vacuum source and said radioactive fluid source.

43. The system of claim 42, wherein said diverter valve is disposable in a first position to allow fluid communication between said radioactive fluid source and said dispensing needle, and wherein said diverter valve is disposable in a second position to allow fluid communication between said vacuum source and said dispensing needle.

44. The system of claim 43, wherein said diverter valve is also disposable in said second position to allow fluid communication between an atmospheric air source and said dispensing needle, said system further comprising a filter between said atmospheric air source and said dispensing needle.

* * * * *